United States Patent [19]

Dohanyos

[11] 4,157,653

[45] Jun. 12, 1979

[54] SHIELDED LOCK ASSEMBLY

[76] Inventor: John A. Dohanyos, 2711 Vestry Ave., Cleveland, Ohio 44113

[21] Appl. No.: 907,827

[22] Filed: May 19, 1978

[51] Int. Cl.[2] ..... E05B 63/00

[52] U.S. Cl. ..... 70/417; 70/56; 70/134

[58] Field of Search ..... 70/54, 55, 56, 57, 90, 70/120, 134, 417

[56] References Cited

U.S. PATENT DOCUMENTS

| | | | |
|---|---|---|---|
| 2,737,045 | 3/1956 | Holmsten | 70/120 |
| 2,766,605 | 10/1956 | O'Brien | 70/417 |
| 3,976,318 | 8/1976 | Krus | 292/346 |
| 4,030,321 | 6/1977 | Kenyon | 70/54 |

*Primary Examiner*—Robert L. Wolfe
*Attorney, Agent, or Firm*—Fay & Sharpe

[57] ABSTRACT

A shielded lock assembly incorporating a body surrounding a deadbolt subassembly. The body renders more difficult access to the deadbolt subassembly in order to reduce the incidence of theft involving the prying, cutting, or other destruction of the deadbolt subassembly. In one embodiment of the invention the deadbolt subassembly is received within a retaining cage which is itself received within the body. Aperture means are provided in the body and the retaining cage which are adapted to receive at least one locking bracket or staple in locking alignment with the deadbolt.

21 Claims, 19 Drawing Figures

FIG. 8
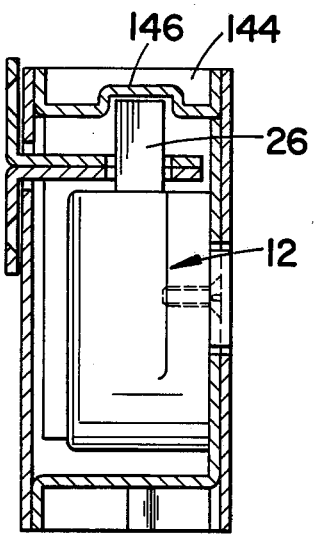
FIG. 9
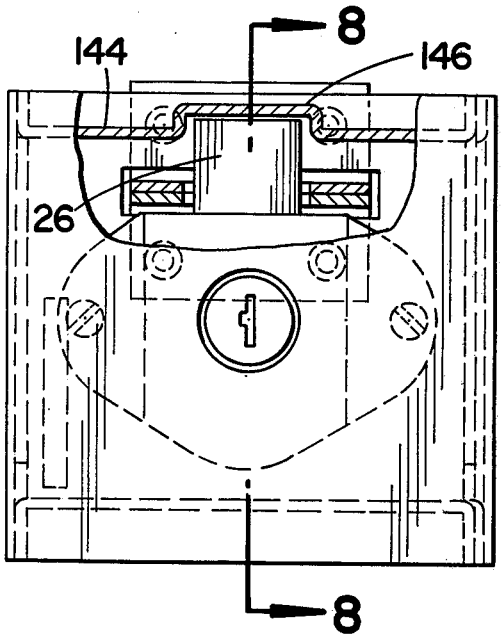
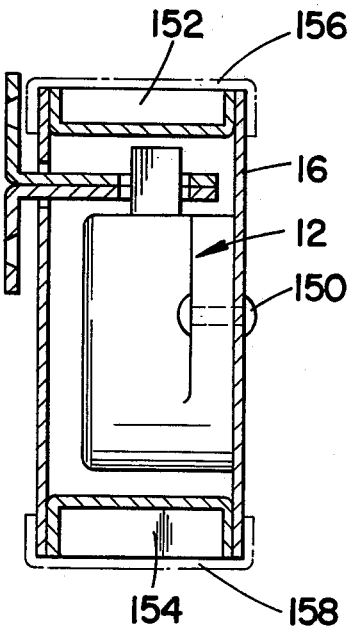
FIG. 10
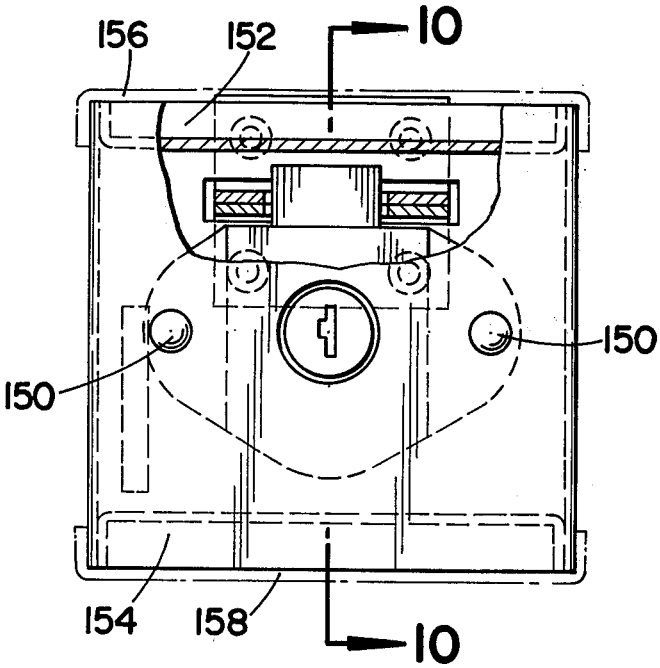
FIG. 11

FIG. 12
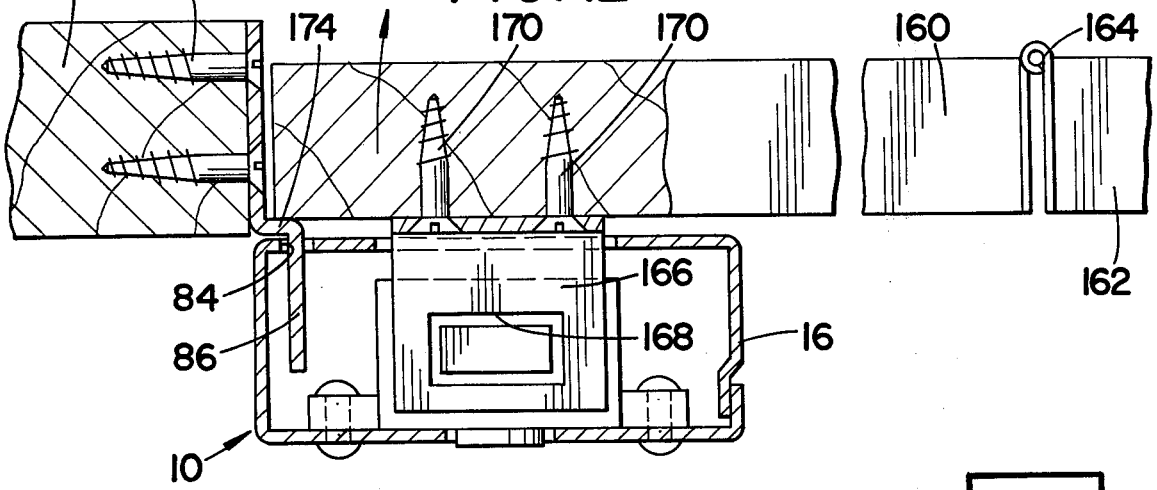
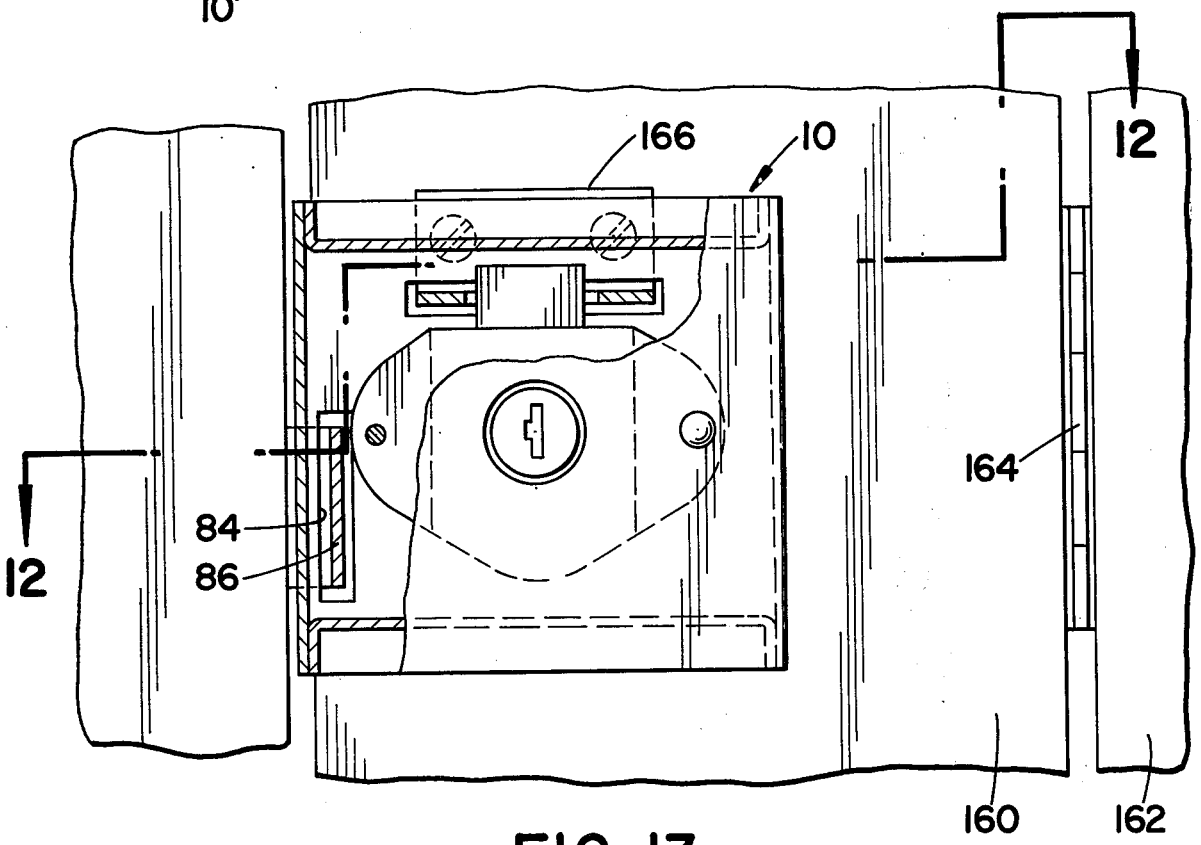
FIG. 13
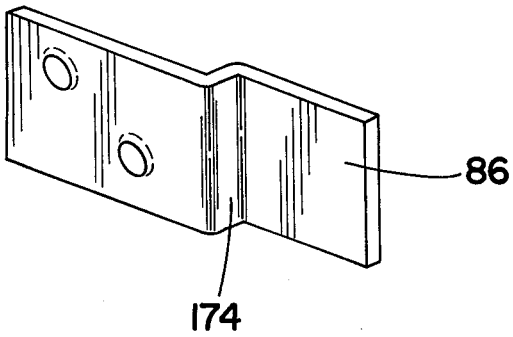
FIG. 14

FIG. 16
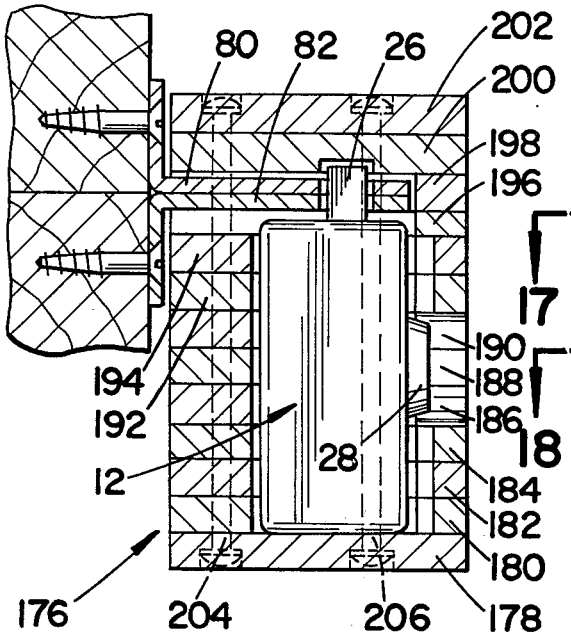
FIG. 15
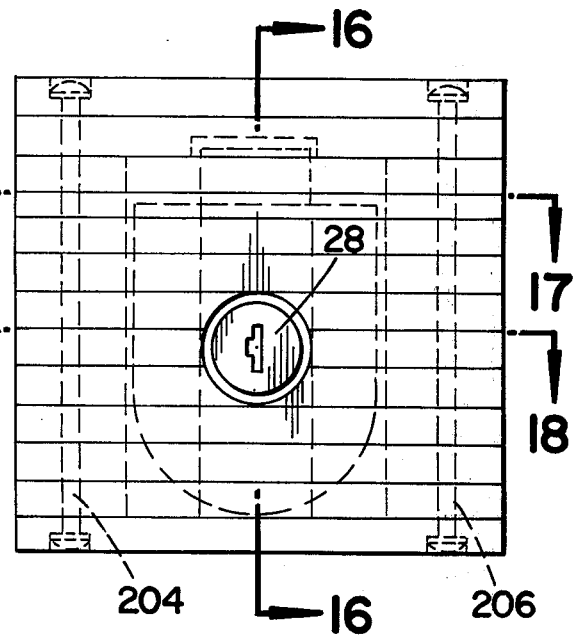
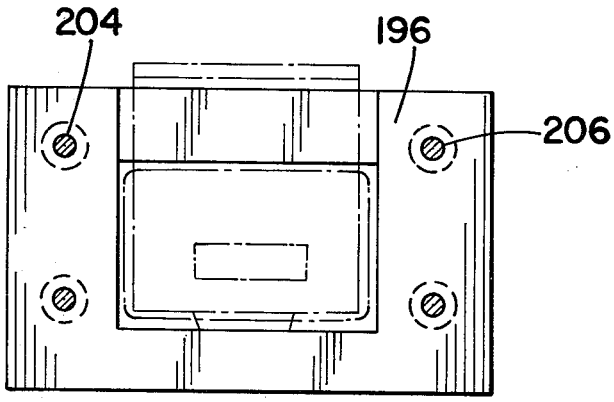
FIG. 17
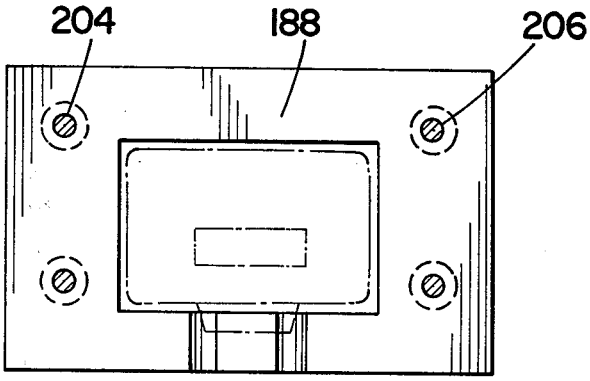
FIG. 18

SHIELDED LOCK ASSEMBLY

BACKGROUND OF THE INVENTION

This invention is directed to a shielded lock assembly. More particularly this invention contemplates the use of a body surrounding a deadbolt subassembly for the purpose of rendering more difficult the destructive access to such subassembly.

Conventional locks generally comprise a locking mechanism which operates with a shackle or deadbolt. The shackle is adapted to cooperate with a locking staple and hasp in order to provide for the locking of a door, window, cabinet, box or the like. Similarly, the deadbolt is adapted to cooperate with a locking bracket in order to provide for the securing of a door, window, etc. Due to their construction however, conventional locks are particularly vulnerable to prying or cutting tools. It is not an uncommon experience for a property owner to discover that his lock has been cut with a bolt cutter or chisel or to find that the lock body has been pried open permitting disassembly of the locking mechanism or disengagement of the shackle or deadbolt.

Numerous attempts have been made to render prior art locks more resistant to thievery. As an example, hardened steel shackles and hardened steel lock body casings have been employed in order to render more difficult the cutting or severing of the shackle or lock body. The use of such special materials, however, not only increases the cost of the lock but in some cases is not totally ineffective as, given enough time, a thief can open virtually any exposed lock.

This invention contemplates the use of a body or housing surrounding a deadbolt subassembly for the purpose of shielding the subassembly from attack by a thief using cutting tools. The body or housing is adapted to closely surround the deadbolt subassembly in a manner such that only the key cylinder of the subassembly is exposed.

Applicant's invention, therefore, contemplates the use of a deadbolt subassembly which is incorporated with applicant's novel housing elements producing a lock assembly of superior theft resistance.

Applicant cautions that his lock assembly is not absolutely immune to unauthorized entry. Indeed no such assertion can be made with respect to any lock assembly since given sufficient time and proper tools and equipment any type of lock assembly can be penetrated. However, in shielding the deadbolt subassembly from access by an unauthorized person applicant's lock assembly serves to retard if not to discourage entirely an attempt to gain unauthorized access to property protected by applicant's lock assembly.

REFERENCE TO RELATED APPLICATION

Applicant's co-pending application, Ser. No. 759,576 filed Jan. 14, 1977, now U.S. Pat. No. 4,106,315 discloses and claims a shielded padlock structure.

SUMMARY OF THE INVENTION

Briefly summarized applicant's invention comprises a body which closely surrounds a deadbolt subassembly. The deadbolt subassembly includes a subassembly body, deadbolt, and a key actuated operating mechanism defined by a lock cylinder. Insertion of an appropriate key into the lock cylinder provides for the extension or retraction of the deadbolt into and out of a locked position and an unlocked position.

In the preferred embodiment of the invention the deadbolt subassembly is secured within a subassembly retaining cage. The retaining cage is defined by a front wall, a pair of side walls, and a bottom wall.

Applicant's lock assembly body is, in the preferred embodiment, defined by a substantially rectangular blank forming a closure member having a front wall, back wall and interconnecting side walls. The retaining cage is adapted to be received within the body and is welded thereto. A closure cap is received within the body and is welded thereto. The cap, body and the bottom wall of the retaining cage provide for the substantial enclosure of the entire deadbolt subassembly.

In a modification of the invention applicant's retaining cage is provided with an internal shoulder adapted to provide support for the deadbolt when in an extended position.

In a further modification of the invention the end cap of the lock assembly body is provided with an emboss to receive the end of the deadbolt when in an extended position.

In a still further modification of the invention the deadbolt subassembly is secured directly to the lock assembly body.

In a still further modification of the invention the lock assembly body is defined by interconnected laminated sections.

BRIEF DESCRIPTION OF THE DRAWINGS

Applicant's invention will be described with reference to the accompanying drawings in which:

FIG. 8 is an elevational view, partly in section and partly in phantom, taken along the line 8—8 of FIG. 9;

FIG. 9 is a front elevational view, partly in section and partly in phantom, of a modification of the invention;

FIG. 10 is a side elevational view, partly in section and partly in phantom, taken along the line 10—10 of FIG. 11;

FIG. 11 is a front elevational view, partly in section and partly in phantom, of a still further modification of the invention;

FIG. 12 is an elevational view, partly in section and partly in phantom, taken along the line 12—12 of FIG. 13;

FIG. 13 is a front elevational view, partly in section and partly in phantom, showing the embodiment of FIG. 10 as installed on a hinged member;

FIG. 14 is an isometric view of the retaining bracket of the form of the invention shown in FIG. 12;

FIG. 15 is a front elevational view, partly in phantom, and showing a still further modification of the invention;

FIG. 16 is a side elevational view, partly in section and partly in phantom, taken along the line 16—16 of FIG. 15;

FIG. 17 is an elevational view, partly in section and partly in phantom, taken along the line 17—17 of FIG. 15;

FIG. 18 is an elevational view, partly in section and partly in phantom, taken along the line 18—18 of FIG. 15;

DESCRIPTION OF THE PREFERRED EMBODIMENT

Figure 3:
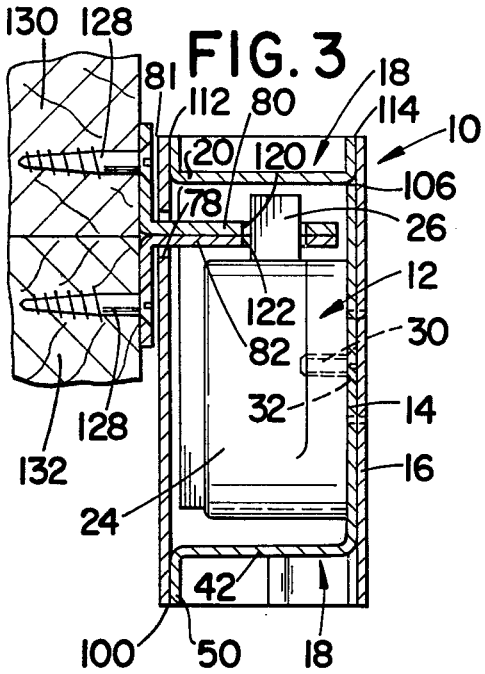
FIG. 3 is an elevational view, partly in section and partly in phantom, taken along the line 3—3 of FIG. 2.

A description of the preferred embodiment of applicant's invention will now be made with reference to FIGS. 1-4. Referring initially to FIG. 3 applicant's lock assembly is generally designated 10 and comprises a deadbolt subassembly 12, a deadbolt subassembly retaining cage 14, a lock assembly body 16, and closure means 18 which, in the preferred embodiment of FIG. 3, is defined by a closure cap 20 and bottom wall 42 of retaining cage 14.

DEADBOLT SUBASSEMBLY

Figure 2:
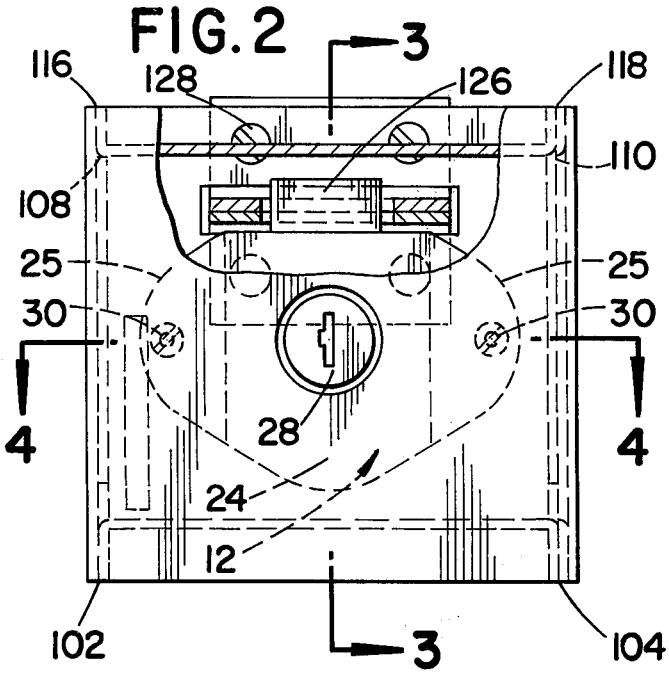
FIG. 2 is an elevational view, partly in section and partly in phantom, of the preferred embodiment of the invention.
Figure 4:
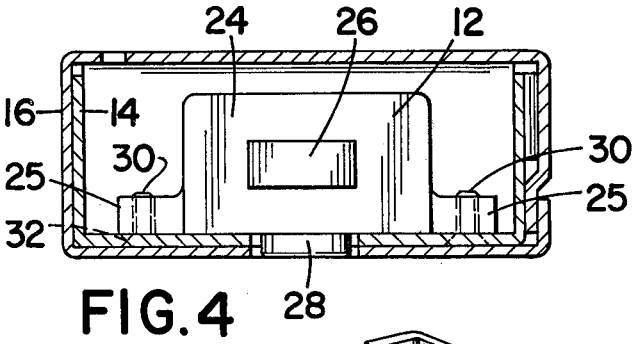
FIG. 4 is an elevational view, partly in section and partly in phantom, taken along the line 4—4 of FIG. 2.

The deadbolt subassembly 12 as shown in FIGS. 2, 3 and 4 is defined by a deadbolt subassembly body 24 (which includes attaching ears 25), deadbolt 26, and a key actuated operating mechanism including a lock cylinder 28. For ease of description the key actuated operating mechanism is not shown in detail in the drawings. Suffice it to say the key actuated operating mechanism is a standard deadbolt operating mechanism well known to those skilled in the art. This type of mechanism includes a lock cylinder 28 which is adapted to receive a suitable key (not shown). By inserting an appropriate key into the lock cylinder and rotating same, deadbolt 26 may be extended or retracted into and out of a locked position and an unlocked position. The locked or extended position of the deadbolt is shown in FIG. 3. In the unlocked or retracted position the deadbolt 26 is very nearly entirely received within the body 24 of the deadbolt subassembly 12.

As best seen in FIGS. 2, 3 and 4 the deadbolt subassembly 12 is secured to the deadbolt subassembly retaining cage 14 by means of fasteners 30 attached to ears 25. Fasteners 30 are provided with a beveled head 32 which are adapted to be received within fastener receiving holes 44 (FIG. 1) defined in the retaining cage 14. The relationship of fasteners 30 to the retaining cage 14 is such that when the deadbolt subassembly 12 is secured to the interior of the retaining cage 14 the outer surfaces of the heads 32 of fasteners 30 are flush with the outer surface of the retaining cage 14. To accomplish this result beveled side walls 46 (FIG. 1) are provided in cage 14.

The deadbolt subassembly 12 (which includes the subassembly body 24, deadbolt 26 and lock cylinder 28) is a commercially available product well known to the industry. The operating mechanism of the deadbolt subassembly forms no part of this invention.

DEADBOLT SUBASSEMBLY RETAINING CAGE

Figures 1, 19:
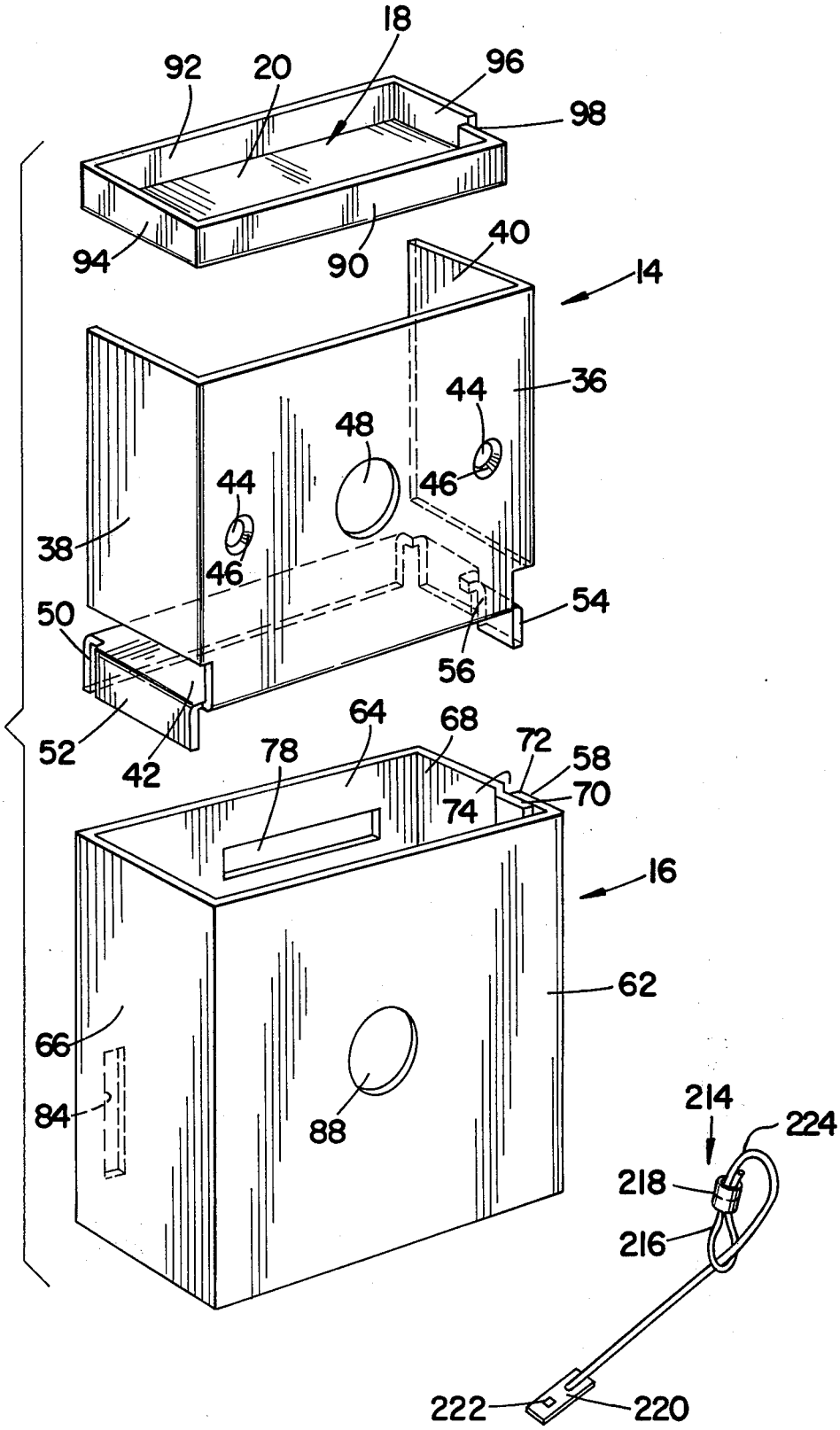
FIG. 1 is an exploded elevational view showing the retaining cage, assembly body and closure cap of the preferred embodiment of applicant's invention.
FIG. 19 is an elevational view of a cable member adapted for use with the shielded lock assembly of the invention.

The deadbolt subassembly retaining cage of the preferred embodiment is generally designated 14 in FIG. 3. Turning to FIG. 1 the specific structure of the retaining cage 14 may be more clearly seen. Retaining cage 14 is defined by a front wall 36, a pair of side walls 38, 40 and a bottom wall 42. Front wall 36 includes a pair of apertures 44 defined by a beveled side wall 46 which are adapted to receive fasteners 30 as shown in FIG. 3. In addition front wall 36 is provided with a lock cylinder receiving aperture 48 which is adapted to receive lock cylinder 28 in the manner shown in FIG. 2.

Bottom wall 42 of retaining cage 14 is provided with a rear edge 50 and a pair of side edges 52, 54. Side edge 54 is provided with an offset portion 56 in order that the retaining cage 14 may be fitted within the body 16 in a manner to be described more fully below.

As shown in FIG. 1 rear edge 50 and side edges 52, 54 are generally parallel to respective walls of the retaining cage. Specifically, rear edge 50 is substantially parallel to front wall 36. Side edge 52 is substantially parallel to side wall 38. Side edge 54 is substantially parallel to side wall 40.

Retaining cage 14 is, in the preferred embodiment, a stamped element fabricated from an appropriate precut blank. Edges 50, 52 and 54 are integral with bottom wall 42. In turn, bottom wall 42 is integral with front wall 36. Similarly side walls 38, 40 are integral with front wall 36. The retaining cage 14 thus defines a one piece construction. Within the spirit of the invention should be considered alternate types of construction of the retaining cage including multi-piece structures welded or otherwise secured together.

LOCK ASSEMBLY BODY

In FIG. 1 the lock assembly body 16 of applicant's invention is shown. As will be seen body 16 is fabricated from a generally rectangular blank forming a closure member with a side seam 58. Assembly body 16 is generally rectangular in cross section in order to receive the generally rectangular (in section) retaining cage 14.

The closure member formed by body 16 includes a front wall 62, back wall 64, and interconnecting side walls 66, 68. As will be seen in FIG. 1 the front wall 62, back wall 64 and side walls 66, 68 define a substantially closed surface.

As was previously indicated assembly body 16 is fabricated from a generally rectangular blank. After forming into the configuration of FIG. 1 the edges of the blank are joined together at side seam 58 by means of welding. In the preferred embodiment an overlapping welded edge is used as is shown in FIG. 1. Edge 70 is offset from side wall 68 in order to be positioned inside of edge 72. The weld is then placed in the space 74 defined by edge 72 and side wall 68.

While in the preferred embodiment of FIG. 1 the cross sectional shape of assembly body 16 is generally rectangular it should be understood that within the spirit of this invention other shapes may be used including, but not limited to, a round or square shape. Similarly while a welded construction is utilized at overlapping edges of the body other methods of joining the edges together may be employed including, but not limited to, the use of adhesives, fasteners and the like. Alternately, seamless construction may be utilized.

Back wall 64 of body 16 includes a generally rectangular aperture 78 which is adapted to receive the locking brackets 80, 82 as shown in FIG. 3. Further discussion of the brackets will follow below.

As will be noted from a study of FIGS. 1 and 3, the cross-sectional shape of aperture 78 is approximately equal to the cross-sectional shape of the locking brackets 80, 82. Thus the locking brackets 80, 82 may be received within the lock assembly in a manner such that the assembly body 16 closely surrounds the locking brackets thus rendering more difficult the insertion of a prying tool.

Back wall 64 may also optionally be provided with a second generally rectangular aperture 84 for the purpose of receiving a retaining bracket 86 when the lock assembly is used in the configuration of FIG. 12. Further discussion with respect to the retaining bracket 86 and the construction of FIG. 12 will follow.

Front wall 62 of body 16 is provided with a lock cylinder receiving aperture 88. Aperture 88 is adapted to be generally aligned with aperture 48 of retaining cage 14 such that the lock cylinder 28 is accessible from the exterior of the body 16.

CLOSURE

This invention provides for closure means 18, FIG. 3, cooperating with body 16 so as to define with body 16 a substantial enclosure of the entire deadbolt subassembly 12. In the preferred embodiment of the invention closure means 18 is defined by a closure cap 20 and bottom wall 42. Closure cap 20, as seen in FIG. 1 has a front edge 90, rear edge 92 and side edges 94, 96. As will be observed from FIG. 1 edges 90, 92, 94 and 96 are generally parallel to respective walls of the retaining cage 14 and assembly body 16. Side edge 96 is provided with an offset portion 98 in order that the edge may accommodate the side seam 58 of body 16.

ASSEMBLY

The shielded lock assembly of this invention is assembled by first attaching the deadbolt subassembly 12 to the retaining cage 14 by the use of fasteners 30 (FIG. 2). Thereafter the retaining cage is telescoped or fitted within the lock assembly body 16 into the position shown in FIG. 3. The retaining cage then is secured to the lock assembly body by means of welds placed at the areas of joinder of the edges 50, 52 and 54 with the interior wall of body 16. Suitable welding points are shown at 100, 102 and 104 of FIGS. 2 and 3. In addition, interior welding points may be utilized such as at 106, 108 and 110 of FIGS. 2 and 3.

After the retaining cage (with the attached deadbolt subassembly) has been secured within the lock assembly body the closure cap 20 is then put in place into the position shown in FIGS. 2 and 3. Closure cap 20 is welded to body 16 at welding points 112, 114, 116 and 118.

Once assembled, the orientation of the deadbolt subassembly 12 to the locking brackets 80, 82 is such that when such brackets are received within the lock assembly in the manner shown in FIG. 3, the apertures 120, 122 of the respective locking brackets are in locking alignment with deadbolt 26. Thus with the locking brackets 80, 82 in the position shown in FIG. 3 deadbolt 26 is free to be extended into a locked position as shown in FIG. 3 as by rotating lock cylinder 28 (FIG. 2) with an appropriate key.

LOCKING BRACKETS

Figure 7:
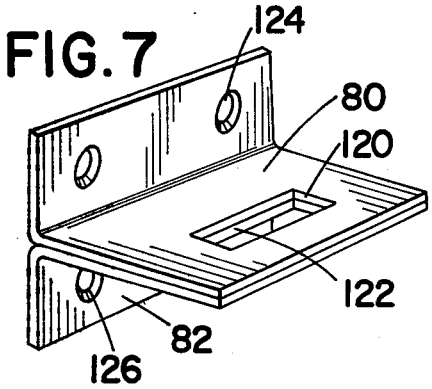
FIG. 7 is an isometric view of the locking brackets of the invention.

The locking brackets of the preferred embodiment of the invention are shown in FIG. 7. Such brackets, which are generally designated 80, 82, are L-shaped and include apertures 124, 126 in order to receive attaching fasteners 128 as shown in FIG. 3. Deadbolt receiving apertures 120, 122 are defined in the respective brackets and are designed to be in the alignment shown in FIG. 7 at such time as the member to be locked is closed and the brackets are passed or projected into the lock assembly.

It should be understood with reference to FIG. 3 that the respective locking brackets 80, 82 are attached to members 130, 132 which may comprise a pair of doors, a door and a jamb, a window and a sill, a cover and a box, or other members which move relative to one another and which are deemed to be locked when retained in the manner shown in FIG. 3.

In the preferred embodiment of the invention as shown in FIGS. 1–4 the shielded lock assembly is described in relation to a pair of locking brackets 80, 82. It should be understood that the lock assembly of this invention is equally applicable to the locking of other elements including staple and hasp structures, and the like. Indeed applicant's lock assembly is adapted to receive one or more locking members which include an aperture adapted to be placed in locking alignment with the interior deadbolt of the assembly. By varying the size and shape of aperture 78 of body 16 (FIG. 1) various configurations of locking brackets, staples and the like may be accommodated by the lock assembly of the invention.

MANNER OF LOCKING

Once assembled as described above the lock assembly of the invention is ready for use. Locking brackets 80, 82 are secured to appropriate members 130, 132 as by attaching the brackets to the members using fasteners 128. Locking of the members 130, 132 is accomplished by simply telescoping or projecting the lock assembly 10 over the outwardly protruding locking brackets 80, 82 into the position shown in FIG. 3. In such position the locking brackets are in alignment with the deadbolt 26. Rotation of key cylinder 28 (FIG. 2) by an appropriate key causes deadbolt 26 to be extended into the locked position shown in FIG. 3 completing the locking of the members 130, 132.

A number of advantages of applicant's shielded lock assembly will be observed in FIG. 3.

First, deadbolt subassembly 12 is housed within the retaining cage 14 which itself is received within the assembly body 16. The front and sides of the assembly are thus defined by a double wall of metal. Virtually the entire deadbolt subassembly 12 is enclosed by the protective enclosure of the invention. There is very little in the way of exposed structure permitting the placement of a prying or cutting tool.

As will further be noted from a study of FIG. 3 virtually the entire locking bracket structure is itself shielded by the lock assembly 10. The lock assembly is snugly received onto the locking brackets 80, 82 with little space defined between the lock assembly and the locking brackets thus rendering difficult the placement of a prying or cutting tool.

In the preferred embodiment the retaining cage and assembly body of the invention are fabricated from 16 gauge (0.062 inches) stainless steel. Other materials and other gauge thicknesses may be utilized depending upon particular requirements.

MODIFICATIONS

Several modifications to the invention are contemplated. Several are shown in the accompanying drawings.

Figure 5:
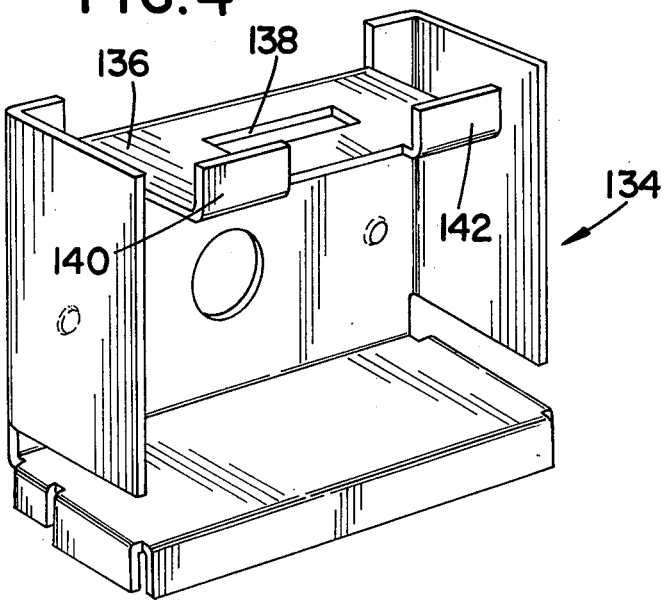
FIG. 5 is an isometric view of a modification of the retaining cage of the invention.

In FIG. 5 a modification of the retaining cage is shown. Specifically retaining cage 134 of FIG. 5 is provided with an internal shoulder 136 which includes a deadbolt receiving aperture 138 and generally upwardly extending lips 140, 142. All of the remaining elements of the retaining cage 134 of FIG. 5 and the lock body 16 (FIG. 6) are identical to corresponding elements of retaining cage 14 and lock body 16 of FIG. 1.

Figure 6:
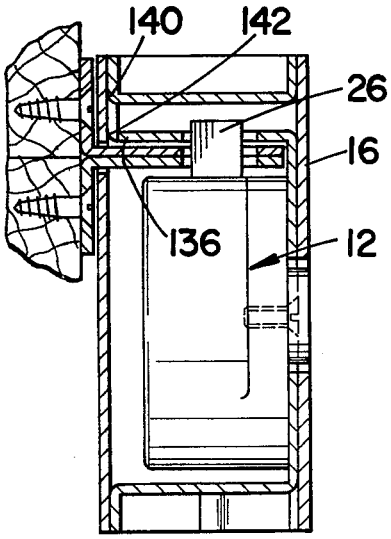
FIG. 6 is an elevational view, partly in section and partly in phantom, of a modification of the invention utilizing the retaining cage of FIG. 5.

As best seen in FIG. 6 the purpose and function of shoulder 134 is to provide for increased security of the lock assembly through the placement of an additional wall of metal above the deadbolt subassembly 12. When positioned as shown in FIG. 6 shoulder 136 extends over the deadbolt subassembly 12. Aperture 138 of shoulder 136 provides means to permit deadbolt 26 to be extended into the locked position of FIG. 6. Lips 140, 142 may be advantageously spot welded to the interior wall of assembly body 16 of FIG. 6 at 140 in order to enhance the security and rigidity of the lock assembly.

In the modification of the invention shown in FIGS. 8 and 9 the closure cap 144 is provided with a generally upwardly extending emboss 146 for the purpose of receiving the upper end of deadbolt 26 in the manner shown. Emboss 146 thus contributes to the security and rigidity of the lock assembly of the embodiment of FIGS. 8 and 9 by providing support for the upper end of the deadbolt when extended to the locked position. In all other respects the operation and structure of the modification of the invention as shown in FIGS. 8 and 9 is similar to that shown in connection with the preferred embodiment of FIGS. 1–4.

Turning now to FIGS. 10 and 11 a still further modification of the invention is shown. As will be seen in FIG. 10 the deadbolt subassembly 12 is secured directly to the assembly body 16 without the provision of an intermediate retaining cage such as in the embodiment of FIG. 1. Fastening means 150 are provided to secure or attach the deadbolt subassembly 12 to the internal wall of the assembly body 16 in the manner shown in FIGS. 10 and 11. Closure caps 152, 154 are utilized at either end of the assembly body 16 and are welded in place in the manner described above in connection with closure cap 20 of FIG. 1. A pair of plastic end caps 156, 158 are positioned as shown in FIG. 10 and essentially cover the closure caps 152, 154. End caps 156, 158 may be retained in place utilizing adhesive or, alternately, an interference fit with assembly body 16. The purpose and function of end caps 156, 158 are to not only improve the visual appearance of the lock assembly of the invention but also to close the exposed inner recesses of the closure caps 152, 154 against collection of moisture, foreign matter and the like.

It should be understood that the end caps 156, 158 as shown in FIG. 10 may be used in connection with any of the embodiments described above including the preferred embodiment of FIG. 1. Helpful information such as directions for use of the lock, the name and address of the lock distributor or manufacturer and a trademark may be placed on the outer surface of the upper end cap 156 in a manner so as to be visible to the operator of the lock assembly. In all other respects the operator of the embodiment of FIG. 10 is similar to that of FIGS. 1–4.

In FIGS. 12 and 13 the embodiment of the invention of FIG. 10 is shown in relation to the locking of a hinged member such as a door or the like. Specifically there is shown in FIG. 12 a door 160 which is hinged to a jamb 162 at hinge member 164. The door is adapted to be swung inwardly or in the arrow direction shown in FIG. 12. Attached to the outer surface of the door is a single locking bracket 166 which includes a deadbolt receiving aperture 168. Fasteners 170 are used to secure locking bracket 166 to the door.

In addition to the locking bracket 166 there is provided in FIG. 12 a retaining bracket 86. Retaining bracket 86 is secured to member 171 by means of fasteners 172. An offset is provided in retaining bracket 86 at 174 such that when the lock assembly is positioned about the locking bracket 166 (as shown in FIG. 12) the retaining bracket will be received within the aperture 84 of the lock assembly body 16. It may be recalled that aperture 84 has previously been described in connection with the discussion of the lock assembly body 16 of FIG. 1. The purpose and function of the retaining bracket 86 is to prohibit the movement of the lock assembly 10 in the arrow direction as shown in FIG. 12. More specifically when secured in place about the locking bracket 166 in the manner shown in FIG. 12 the door member 160 will otherwise be locked in place. It will not be possible to swing the door inwardly (or in the arrow direction shown in FIG. 12) due to the interference of the retaining bracket 86 with the lock assembly body 16.

An isometric view of the retaining bracket as employed in the embodiment of FIG. 12 is shown in FIG. 14.

One additional modification of the invention will now be described with reference to FIGS. 15–18. As best seen in FIG. 16 a modification of the invention is contemplated wherein the deadbolt subassembly 12 is received within an assembly body 176 that is characterized generally by a plurality of laminated sections 178–202. Sections 178 and 202 define end caps. Intermediate sections 180–200 define a body structure including various internal recesses adapted to receive deadbolt subassembly 12 and the locking brackets 80, 82. Two pairs of through bolts 204, 206 are employed to retain the several laminated sections together.

From a study of FIGS. 17 and 18 it can be appreciated that the respective laminated sections cooperate to substantially entirely enclose or surround the deadbolt subassembly 12 while, at the same time, providing access to the lock cylinder 28 and permitting entry of the locking brackets 80, 82 into the lock assembly.

In the operation of the embodiment of FIGS. 15–18 rotation of the lock cylinder 28 causes the deadbolt 26 to move to an extended or locked position within the locking brackets 80, 82.

Other modifications of applicant's lock assembly are contemplated and should be considered within the spirit of the invention.

Referring to the preferred embodiment of the retaining cage 14 of FIG. 1 it can be appreciated that alternate retaining cage structures may be utilized. Specifically structures may be employed in which there is provided a back wall in the retaining cage opposite the front wall 36 of FIG. 1. Alternately structures could be utilized in which an upper wall is provided similar to but oppositely directed from the bottom wall 42. In still further alternate embodiments the bottom wall 42 could be eliminated and a bottom closure cap (similar to cap 20) utilized. In other embodiments a closure cap and transverse wall (in the retaining cage) could be used concurrently to provide two thicknesses of metal at the top and bottom of the lock assembly.

In FIG. 19 a length of cable is shown that is suitable for use with the lock assembly of this invention. Such cable may be used for locking or securing such property as bicycles, motorcycles, picnic tables and the like. Cable 214 of FIG. 19 is defined by a relatively small loop 216 at one end. Loop 216 is formed by joining the end of the cable to an intermediate portion by means of a ferrule or collar 218 swaged to the cable. The other end of the cable is provided with a locking member 220 (attached to the cable) which includes a deadbolt receiving aperture 222. It should be understood that locking member 220 is adapted to be inserted into the lock assembly of this invention in the manner shown in FIG. 3.

When it is desired to lock a bicycle or other such property the member 220 is first passed through the wheel of the bicycle. Thereafter the member 220 is passed through the loop 216. Thus it should be understood that the larger loop 224 is received through a portion of the property to be secured. Finally, the lock assembly is secured to the member 220 to prevent withdrawal of the member 220 through loop 216.

In an alternate embodiment of cable structure a pair of locking members 220 may be used (at either end of the cable) and secured together by means of the lock assembly in the manner shown in FIG. 3. The cable ends thus function in a manner similar to the brackets 80, 82 of FIG. 3.

In FIG. 1 the apertures 78, 84 are shown in the back wall 64. It should be understood that bracket receiving apertures may be provided in the side walls 66, 68 or even in the front wall 62.

Referring to FIG. 3 it has previously been noted that a slight clearance 81 is defined between the locking bracket 80 and the body 16. To reduce the opportunity to insert a prying tool the bracket 80 may be provided with an outwardly extending lip or flange to overlie a portion of the closure cap 20. Alternately the closure cap 20 may be provided with an overhanging portion to overlie the leg of the bracket at member 130.

What is claimed is:

1. A shielded lock assembly for a locking bracket, staple, or the like comprising in combination:

a deadbolt subassembly including a deadbolt subassembly body, deadbolt, and a key actuated operating mechanism including a lock cylinder for extending and retracting the deadbolt into and out of a locked position and an unlocked position;

a deadbolt subassembly retaining cage;

means to secure said deadbolt subassembly in said retaining cage such that said lock cylinder is accessible from the exterior of said retaining cage;

a lock assembly body defined by a front wall, back wall and interconnecting side walls, said walls together defining a substantially closed surface;

means to secure said retaining cage within said lock assembly body such that said lock cylinder is accessible from the exterior of said lock assembly body;

aperture means in said lock assembly body and said retaining cage adapted to receive at least one locking bracket or staple in locking alignment with said deadbolt;

closure means cooperating with said lock assembly body so as to define with said lock assembly body a substantial enclosure of said deadbolt subassembly.

2. The invention of claim 1 in which said lock assembly body is defined by a substantially rectangular blank formed into a closure member with a side seam and having a generally rectangular cross section.

3. The invention of claim 2 in which said side seam is defined by overlapping welded edges of said blank.

4. The invention of claim 3 in which one edge of said blank is offset with respect to the other edge.

5. The invention of claim 2 in which said aperture means in said body is defined by a slot having a cross-sectional shape approximately equal to the cross-sectional shape of said locking bracket or staple.

6. The invention of claim 1 in which said deadbolt subassembly retaining cage is defined by a front wall, a pair of side walls and a bottom wall.

7. The invention of claim 6 in which said deadbolt subassembly is secured to said front wall of said retaining cage.

8. The invention of claim 6 in which said bottom wall is provided with a rear edge and a pair of side edges.

9. The invention of claim 8 in which said edges are respectively generally parallel to said front wall and said side walls of said retaining cage and are welded to said lock assembly body.

10. The invention of claim 8 in which one of said edges is provided with an offset portion to accommodate a side seam of said lock assembly body.

11. The invention of claim 6 in which there is provided an aperture in said front wall of said retaining cage to provide access to said lock cylinder.

12. The invention of claim 11 in which there is provided an aperture in said front wall of said lock assembly body approximately concentric with said aperture and said front wall of said retaining cage.

13. The invention of claim 1 in which said closure means is defined by a cap member secured to said assembly body and a bottom wall defined by said retaining cage.

14. The invention of claim 13 in which said cap member is provided with an emboss to receive the end of said deadbolt.

15. The invention of claim 1 in which said closure means is defined by a pair of cap members secured to said assembly body.

16. The invention of claim 15 in which said cap members are generally planar and are provided with upstanding front, rear and side edges welded to said lock assembly body.

17. The invention of claim 1 in which a support shoulder is defined within said retaining cage including an aperture to receive said deadbolt when extended into a locked position.

18. A shielded lock assembly for a locking bracket, staple or the like comprising in combination:

a deadbolt subassembly including a deadbolt subassembly body, deadbolt, and a key operated operating mechanism including a lock cylinder for extending and retracting the deadbolt into and out of a locked position and an unlocked position;

a lock assembly body;

means to retain said deadbolt subassembly in said lock assembly body such that said lock cylinder is accessible from the exterior of said lock assembly body;

aperture means in said lock assembly body adapted to receive at least one locking bracket or staple in locking alignment with said deadbolt;

closure means cooperating with said lock assembly body so as to define with said lock assembly body a substantial enclosure of said deadbolt subassembly.

19. The invention of claim 18 in which said lock assembly body is defined by a front wall, back wall and interconnecting side walls, said walls together defining a substantially closed surface.

20. The invention of claim 19 in which said closure means is defined by a pair of cap members secured to said body.

21. The invention of claim 18 in which said body is defined by a plurality of laminated sections secured together, some of said sections having internally removed portions to accommodate said deadbolt subassembly and a locking bracket or staple, other laminated sections defining end caps.

* * * * *